United States Patent [19]

Jones

[11] 4,125,334

[45] Nov. 14, 1978

[54] APPARATUS FOR MIXING TWO FLOWABLE SUBSTANCES

[75] Inventor: Graham S. Jones, Woodville, Nr. Burton-on-Trent, England

[73] Assignee: Coal Industry (Patents) Limited, London, England

[21] Appl. No.: 852,455

[22] Filed: Nov. 17, 1977

[51] Int. Cl.[2] ..... B01F 5/00; B28C 5/04

[52] U.S. Cl. ..... 366/181; 141/9; 366/336

[58] Field of Search ..... 366/177, 178, 181, 189, 366/336–341; 141/9, 113, 234, 236, 237, 242, 285, 286

[56] References Cited

U.S. PATENT DOCUMENTS

| | | | |
|---|---|---|---|
| 2,455,572 | 12/1948 | Evans | 366/336 |
| 3,294,490 | 12/1966 | Hach | 366/178 X |
| 3,423,076 | 1/1969 | Jacobs et al. | 366/337 |
| 3,976,109 | 8/1976 | Bailey | 141/9 |

*Primary Examiner*—Leonard D. Christian

*Attorney, Agent, or Firm*—Stevens, Davis, Miller & Mosher

[57] ABSTRACT

An apparatus for mixing two flowable substances, such as flocculent and water, comprises a first container into which a first flowable substance is fed and from which the first substance overflows onto an inclined face, the second flowable substance being fed into a second container from which it overflows onto the inclined face and mixes thereon with the first substance, and an outlet for the mixed substances flowing down the inclined face.

8 Claims, 1 Drawing Figure

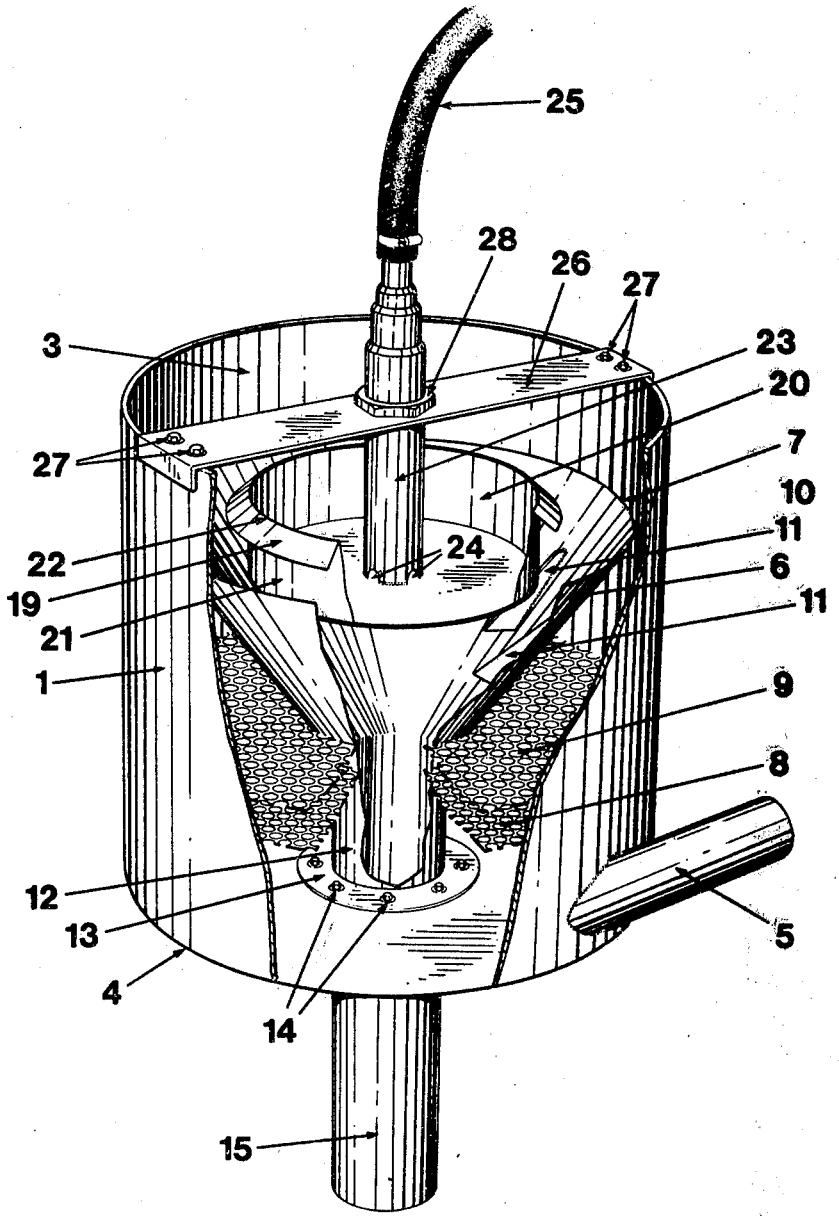
25
28
26
27
3
23
20
27
7
10
11
22
24
6
19
11
21
1
9
8
12
13
5
4
14
15

APPARATUS FOR MIXING TWO FLOWABLE SUBSTANCES

The present invention concerns apparatus for mixing two flowable substances. In particular, although not exclusively, this invention concerns apparatus for mixing a liquid containing flocculant with effluent containing fines from a mineral preparation plant.

An aim of the present invention is to provide an improved apparatus for mixing two flowable substances which is relatively simple, inexpensive and from which the resulting mixture has a desired, substantially uniform concentration.

According to the present invention, apparatus for mixing two flowable substances comprises a first container for a first flowable substance having first inlet means, a first overflow lip over which, in use, said first flowable substance overflows, an inclined face down which said first flowable substance overflowing said first overflow lip flows, a second container for the second of the flowable substance having second inlet means, a second overflow lip over which, in use, said second flowable substance overflows onto the inclined face and mixes thereon with said first flowable substance flowing down the inclined face, and outlet means for the resulting mixed flowable substance flowing down the inclined face.

The invention also provides a method of mixing two flowable substances, which method comprises feeding a first flowable substance to a first container from which it overflows onto an inclined face and flows down said inclined face, feeding a second flowable substance to a second container from which it overflows onto said inclined face and mixes thereon with said first flowable substance, and removing the mixed flowable substances.

Preferably, said first container is cylindrical.

Conveniently, the inclined face is constituted by the curved inner face of an inverted cone positioned within the first container, the uppermost rim of the cone defining said first overflow lip. Preferably, guide plates are provided on said inclined face, to provide a desired flow pattern.

Preferably, the outlet means comprises an outlet pipe positioned substantially at the apex of the cone.

Advantageously, said second container comprises a cylindrical dish mounted co-axially with the cone. Preferably, said second overflow lip is constituted by an uppermost margin of the dish's cylindrical wall. More preferably, a portion of the uppermost margin is turned outwards and inclined downwards with respect to the remainder of the cylindrical wall, said second overflow lip being defined by the intersection of said remainder of the cylindrical wall and the turned portion.

Preferably, the first inlet means comprises an inlet pipe tangentially adjacent to the base of the first container.

Advantageously, at least one perforated baffle plate is provided in the path of said first flowable substance flowing up in the first container.

Preferably, the second inlet means includes a vertically extending pipe supportably secured to the second container. Advantageously, the vertically extending pipe is provided with cut outs in its wall for feeding said second flowable substance into the second container. Conveniently, the second inlet means includes a central valve for controlling the feed of said second flowable substance into the second container.

By way of example only, one embodiment of the present invention will be described with reference to the accompanying drawing in which the FIGURE is a perspective view, partly cut away, of apparatus for mixing two flowable substances in accordance with the present invention.

The apparatus in the drawing is for use in a coal preparation plant and is for mixing a liquid containing flocculant with an effluent containing fines.

The apparatus comprises a cylindrical container 1 open at its upper end 3 and closed at its base 4. Inlet means 5 for effluent containing fines comprises a feed pipe tangentially arranged adjacent to the base 4 of the container. An inverted cone 6 is mounted co-axially within the cylindrical container 1 with its rim 7 constituting an overflow lip for effluent led into the container 1. Two perforated plates 8 and 9 are provided in the path of the effluent flowing up the container to urge the effluent to flow up the container rather than tangentially around the container. Thus, the effluent tends to overflow the lip 7 uniformly all along the length of the lip. Consequently, the overflow lip 7 tends to produce a uniform streamline flow down the cone's inner inclined face 10. Baffle plates 11 are provided at spaced intervals around the inclined face 10 to help maintain the uniform streamline flow of effluent down all the area of the inclined face and to help prevent flow around the curved inclined face.

The apex of the cone 6 is provided with an outlet pipe 12 secured to the base 4 of the container 1 by a flange 13 and bolts 14, and to an extension outlet pipe 15 which feeds the discharge from the apparatus to a settling tank (not shown).

The apparatus also comprises a cylindrical dish shaped container 20 mounted co-axially with, and above, the cone 6 and having a closed base and an overflow lip 22 formed by the uppermost margin of the container at the intersection between a turned over portion 19 of the uppermost margin of the container 20 and the upright cylindrical wall 21 of the container 20. The turned over portion 19 is inclined downwardly and outwardly from the upright wall 21. Inlet means for liquid containing flocculant comprises a vertical pipe 23 welded at its lower end to the base of the container 20 and having semi-circular cut outs 24 in its wall for allowing the passage of liquid into the container 20. The pipe 23 is connected to a feed hose 25 which in turn is connected to a control valve (not shown) in a feed line (not shown), the control valve being capable of controlling the flow of liquid from zero flow to a preselected maximum. The pipe 23 (and thereby the container 20) is supported on a cross bracket 26 secured by bolts 27 to the uppermost rim of the container 1, the pipe being retained in position by a locking nut 28.

In use, effluent containing fines from a coal preparation plant is fed tangentially into the container 1 via inlet pipe 5 so as to sweep around the whole base of the container 1. As the effluent rises up the container any tangential flow tends to be eliminated by the two perforated plates 8 and 9 so that by the time the effluent reaches the overflow lip 7 all flow tends to be upwards and radially towards the lip so that a continuous, uniform and streamline flow is produced down the inclined face 10 of the cone 6, the baffle plate 11 tending to prevent flow in a direction around the curved inclined face.

Simultaneously, liquid, usually water, containing flocculant is fed via hose 25 and the cut outs 24 in the wall of the pipe 23 is fed adjacent to the base of the cylindrical dish shaped container 20 so that the liquid rises up the container 20 and overflows the lip 22 to flow down the turned portion 19 and fall as a substantially continuous cylindrical curtain onto the uniform, streamline flow of effluent flowing down the curved inclined face 10 of the cone 6. Thus, the two flowable substances are efficiently and continuously intermixed, the feed of liquid containing the flocculant being central to ensure that a desired preselected dosage is achieved.

The resulting mixture is fed via outlet pipes 12 and 15 to a settling tank where the fines under the effect of the flocculant are allowed to settle.

From the above description it can be seen that the present invention provides apparatus for mixing two flowable substances which while being relatively simple, compact and efficient has an extensive mixing zone enabling relatively large flows to be intermixd. In a typical example, the rate of effluent feed is three to five hundred gallons per minute, the rate of liquid containing flocculant feed being varied, for example, between 0 flow and 50 gallons per minute.

I claim:

1. An apparatus for mixing two flowable substances, which apparatus comprises a first container for a first flowable substance, said first container having first inlet means and a first overflow lip, a second container for the second flowable substance, said second container having second inlet means and a second overflow lip, an inclined face positioned below both first and second overflow lips and outlet means, whereby a first flowable substance fed into said first container overflows said first overflow lip onto said inclined face, a second flowable substance fed into said second container overflows said second overflow lip onto the inclined face and mixes thereon with the first flowable substance.

2. An apparatus as claimed in claim 1, wherein said first container is cylindrical.

3. An apparatus as claimed in claim 1, wherein said inclined face is the inner face of an inverted cone positioned within said first container.

4. An apparatus as claimed in claim 3, wherein the uppermost rim of the cone defines the first overflow lips.

5. An apparatus as claimed in claim 3, wherein said second container is a dish having a bottom and a cylindrical wall mounted co-axially with the cone.

6. An apparatus as claimed in claim 5, wherein said second overflow lip is constituted by an uppermost margin of the dish's cylindrical wall.

7. An apparatus as claimed in claim 6, wherein a portion of said margin is turned outwards and inclined downwards with respect to the cylindrical wall.

8. A method of mixing two flowable substances, which method comprises the steps of feeding a first flowable substance into a first container from which it overflows onto and flows down an inclined face, feeding a second flowable substance to a second container from which it overflows onto said inclined face and mixes thereon with said first flowable substance, and removing the mixed substances.

* * * * *